US005785270A

United States Patent [19]

Buchko

[11] Patent Number: 5,785,270

[45] Date of Patent: Jul. 28, 1998

[54] COMBINED SUPPORT, ADJUSTMENT AND BRAKING MECHANISM FOR USE IN UNWINDING A ROLL OF WEB MATERIAL

[75] Inventor: Raymond G. Buchko, Appleton, Wis.

[73] Assignee: Rapidpak, Inc., Appleton, Wis.

[21] Appl. No.: 531,071

[22] Filed: Sep. 20, 1995

[51] Int. Cl.[6] ..... B65H 23/06

[52] U.S. Cl. ..... 242/422.4; 242/396.8; 242/421.9; 242/596.3; 242/599.2

[58] Field of Search ..... 242/422.4, 421.8, 242/421.9, 396.6, 396.7, 396.8, 596.3, 599.3, 592, 599.2, 599, 563.1

[56] References Cited

U.S. PATENT DOCUMENTS

| | | | |
|---|---|---|---|
| 862,997 | 8/1907 | Riley, Jr. et al. | 242/599.3 X |
| 3,815,841 | 6/1974 | Wolff | 242/422.4 |
| 4,209,140 | 6/1980 | Seibert | 242/596.3 X |
| 4,610,407 | 9/1986 | Stubbmann | 242/422.4 X |
| 4,660,781 | 4/1987 | Hazard | 242/422.4 X |
| 4,664,332 | 5/1987 | Barazone | 242/596.3 |
| 4,682,741 | 7/1987 | Honegger | 242/422.4 X |
| 5,511,713 | 4/1996 | Sakaguchi et al. | 242/563.1 X |
| 5,524,834 | 6/1996 | Bogucki-Land | 242/422.4 X |
| 5,538,200 | 7/1996 | Tatum | 242/599.3 X |

*Primary Examiner*—Donald P. Walsh
*Assistant Examiner*—William A. Rivera
*Attorney, Agent, or Firm*—Andrus, Sceales, Starke & Sawall

[57] ABSTRACT

A support for rotatably mounting a roll of web material includes a braking and roll position adjustment mechanism. The support is in the form of a series of support rods extending between a pair of end plates, which engage the internal walls of the roll core at spaced locations. The braking mechanism consists of a brake shaft which extends through the roll core, and which bears against the roll core during its rotation to apply resistance as the web is being unwound from the roll. The brake shaft can selectively be moved to a disengaged position in which it is moved out of engagement with the core. The roll position adjustment mechanism includes a rotatable shaft which extends through the roll core, and to which the brake shaft is pivotably mounted via a pair of arms. One of the arms is threadedly engaged with external threads provided on the rotatable shaft, and a pair of collars are engaged with the brake shaft such that one collar is located immediately adjacent each end of the roll core. Turning of the rotatable shaft results in longitudinal movement of the brake shaft in a direction parallel to the longitudinal axis of the roll core, which results in longitudinal movement of the roll via engagement of the collars with the ends of the roll core.

18 Claims, 3 Drawing Sheets

FIG.1
(PRIOR ART)
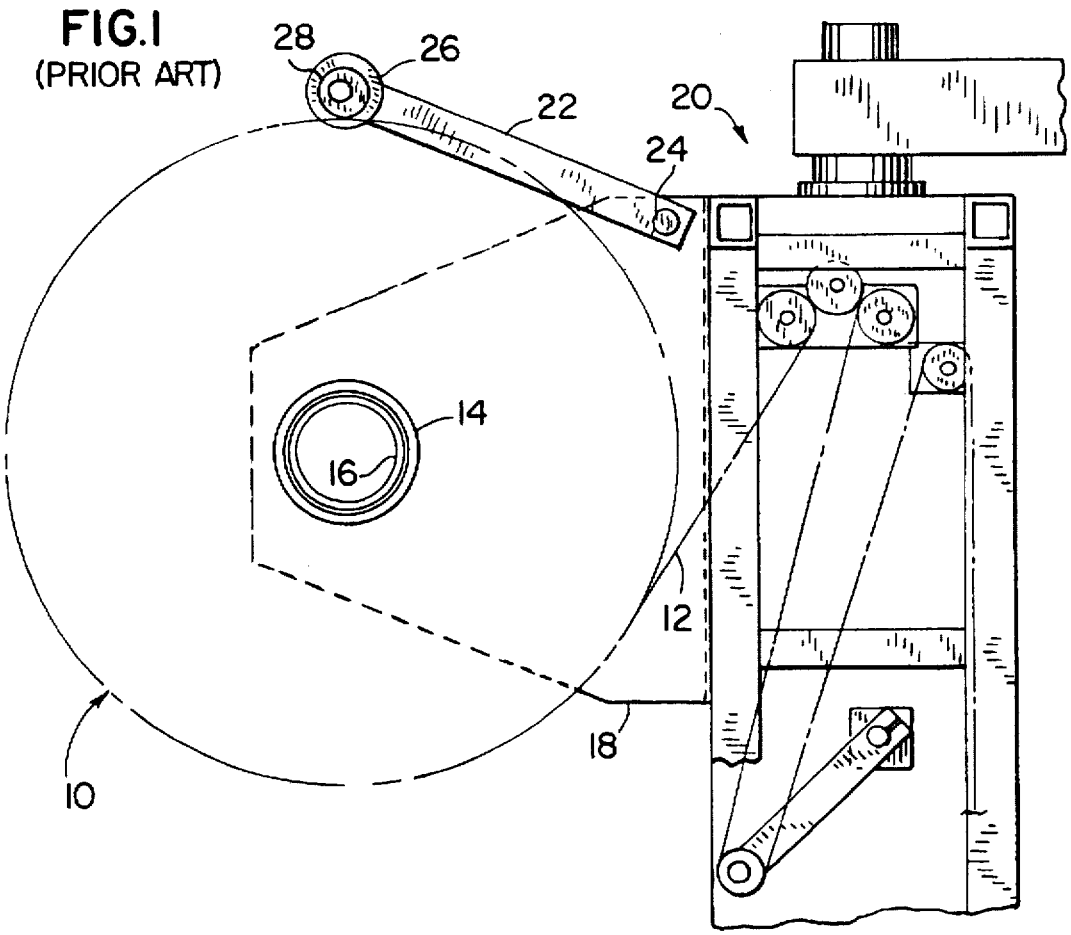
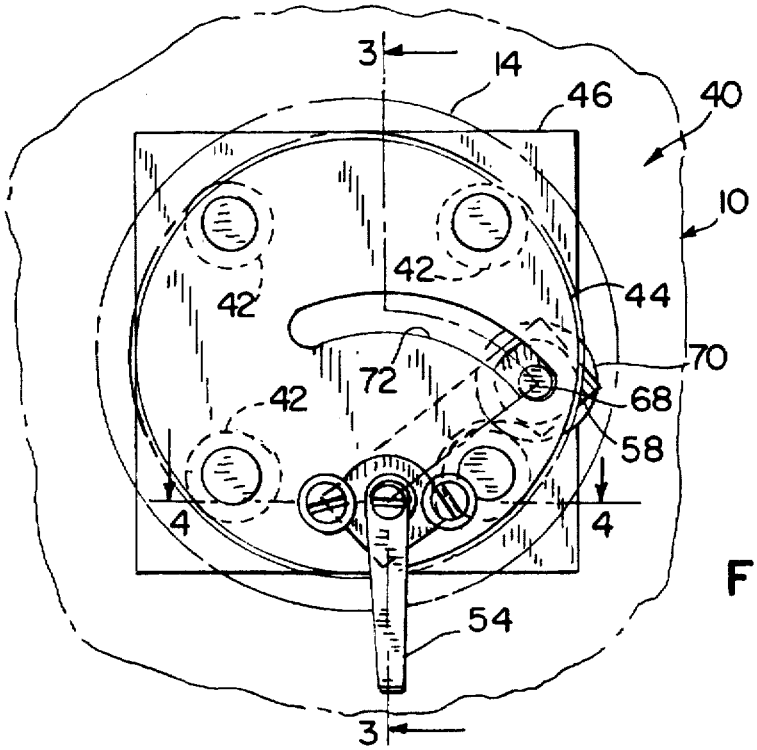
FIG. 2

COMBINED SUPPORT, ADJUSTMENT AND BRAKING MECHANISM FOR USE IN UNWINDING A ROLL OF WEB MATERIAL

BACKGROUND AND SUMMARY OF THE INVENTION

This invention relates to a device for supporting a wound roll of web material as the web material is being unwound from the roll.

Mounting, positioning and controlling a roll of web material as it is being unwound can be a difficult task. Typically, the roll is wound on a paperboard core, and is slit to customer specifications. In the past, it has been known to provide a metal tube with a round cross-section which serves as the roll arbor, i.e. which rotatably supports the roll in a location adjacent the machinery utilizing the unwound web. One such application is in packaging machinery, which utilizes a wound roll of packaging film which is unwound during operation of the packaging machine.

In the past, lateral positioning of the roll on the arbor has been provided by a pair of arms located one at either end of the roll, for engaging the outermost layers of the film at the roll ends. The arms are mounted to a threaded rod, which can be turned to push one or the other of the arms against the film and to cause sliding movement of the roll on the arbor. A drawback to this arrangement is that the weight of the arms can cause the layers of film to bunch and wrinkling of the film, which can result in the guide arms lifting off the roll during rotation of the roll and resulting in a loss of position control. In addition, if the film is wound loosely on the core, the film layers engaged by the arms will "telescope" relative to the lower film layers. This causes the film to track improperly as it is being unwound from the core.

In addition, a brake arrangement is required in order to maintain tension on the film as it is being unwound. A certain minimum level of tension is required in order to maintain proper film tracking and to prevent the roll from over-spinning as it is being unwound.

In addition, there is a need in the food packaging field to provide a film roll support having improved sanitation over prior art designs, which minimizes areas in which moisture or other debris can accumulate.

It is an object of the present invention to provide an improved support for a roll of web material which provides roll support, lateral position and braking in a single assembly mountable adjacent a device utilizing the unwound web material. It is a further object of the invention to provide such a roll support which is relatively simple in its construction, functioning and operation, yet which provides significant advantages in operation and sanitation over prior roll support and positioning mechanisms. A further object of the invention is to provide a roll support which can accommodate and position a roll regardless of the consistency in the lateral positioning of the web as it is being unwound and regardless of the winding tightness of the roll. Yet another object of the invention is to provide such a roll support which avoids contacting the web material.

In accordance with one aspect of the invention, a support for a roll having a core defining an internal passage includes a series of spaced, elongated support members which extend through the internal passage of the core and which engage the core at spaced locations. The support members are secured to a mounting arrangement for mounting the support members at a location adjacent a roll unwinding device, such as a packaging machine or any other device utilizing web-like material which is unwound from a roll during operation.

The support members are preferably in the form of elongated rods which define first and second ends, with each rod being mounted at its first end to a first end plate and mounted at its second end to a second end plate. The support rods include at least a pair of horizontally spaced upper support rods which engage the core at locations equidistant from a vertical plane which passes through the longitudinal axis of the core. One of the end plates is dimensioned so as to fit within the internal passage of the core, to enable the core to be slid onto the support rods. In a preferred form, a pair of lower support rods are disposed below the pair of upper support rods, so that the core is engaged at four equally radially spaced locations.

In accordance with another aspect of the invention, a roll support includes an elongated support which extends through the core for rotatably supporting the core, and a roll brake member selectively movable between an engaged position in which the brake member engages the core, and an disengaged position in which the brake member is moved out of engagement with the core. In its engaged position, the brake member functions to resist rotation of the core as the roll is being unwound. The brake member is preferably in the form of an elongated, rotatable member engageable with an internal wall of the core defining the core internal passage. The brake member is mounted to a pair of arms located one on either side of the roll, and the arms are pivotable so as to provide pivoting movement of the brake member between its engaged and disengaged positions. The arms are pivotably mounted to a shaft. The support is preferably in the form as summarized above, consisting of a series of spaced support members extending between a pair of end plates. The shaft extends between and is interconnected with the end plates. One of the end plates includes an arcuate slot, and a handle extends through the slot and is interconnected with the brake member. Engagement of the handle with the slot ends controls the range of movement of the brake member, and accommodates movement of the brake member between its engaged and disengaged positions. Preferably, the handle is in the form of an extension of a shaft associated with the brake member, which extends past one of the arms and through the slot.

In accordance with yet another aspect of the invention, a roll support includes an elongated support which extends through the roll core and a roll position adjustment mechanism for adjusting the longitudinal position of the core on the support. The roll position adjustment mechanism includes a pair of collar members, each of which is selectively engageable with an end of the core, and an adjustment mechanism interconnected with the collar members for selectively moving the collar members in a direction substantially parallel to the longitudinal axis of the core. This movement of the collar members functions to cause sliding longitudinal movement of the core on the support through engagement of the collar members with the ends of the core, to adjust the lateral position of the roll without engaging the web material. The collar members are slidably mounted to an elongated member which extends through the core passage, and are selectively engageable with the elongated member to fix the longitudinal position of the collar members relative to the elongated member, and to enable the collar members to be positioned adjacent the core ends. An elongated rotatable shaft extends through the core, and includes a threaded portion. A pair of arms extend between the elongated member and the rotatable shaft, and one of the arms is threadedly engaged with the threaded portion of the shaft. Rotation of the shaft causes longitudinal movement of the first arm in a direction parallel to the longitudinal axis of the core passage. This results in axial sliding movement of the core along the elongated support member, through engagement of the collars with the core ends. As before, the support is preferably in the form of a series of rods connected at each end to a plate, and the rotatable shaft is rotatably engageable with the plates.

The various aspects of the invention can be employed separately from each other. However, in a preferred form, all aspects of the invention are combined into a single assembly. In accordance with this combination aspect of the invention, a roll support includes a series of spaced, elongated support rods which extend through the internal passage of the core and which engage the core at spaced locations to support the roll. A brake member is movable between an engaged position in which it engages an internal wall of the core defining the core passage, and a disengaged position in which it is moved out of engagement with the core. A roll position adjustment mechanism includes a pair of collars mounted to the brake member on either side of the core to engage the ends of the core, and a shaft having a threaded portion extending through the core. A pair of pivotable arms are pivotably secured at one end to the shaft, and of the other end to the brake member, to provide pivoting movement of the brake member between its engaged and disengaged positions. One of the arms is threadedly engaged with the threaded portion of the shaft, such that rotation of the shaft results in longitudinal movement of the arm, and thereby the brake member, causing longitudinal movement of the core through engagement of the collars with the core ends. The support rods are mounted at each end to an end plate, and the rotatable shaft is rotatably mounted to the end plates. The arms serve the dual purpose of moving the brake member into and out of engagement with the core, and also to adjust the lateral position of the core upon rotation of the rotatable shaft.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a partial side elevation view showing a prior art roll support and web guide mechanism;

FIG. 2 is a side elevation view of the roll support, web guide and brake system of the invention;

DETAILED DESCRIPTION OF THE INVENTION

Figure 3:
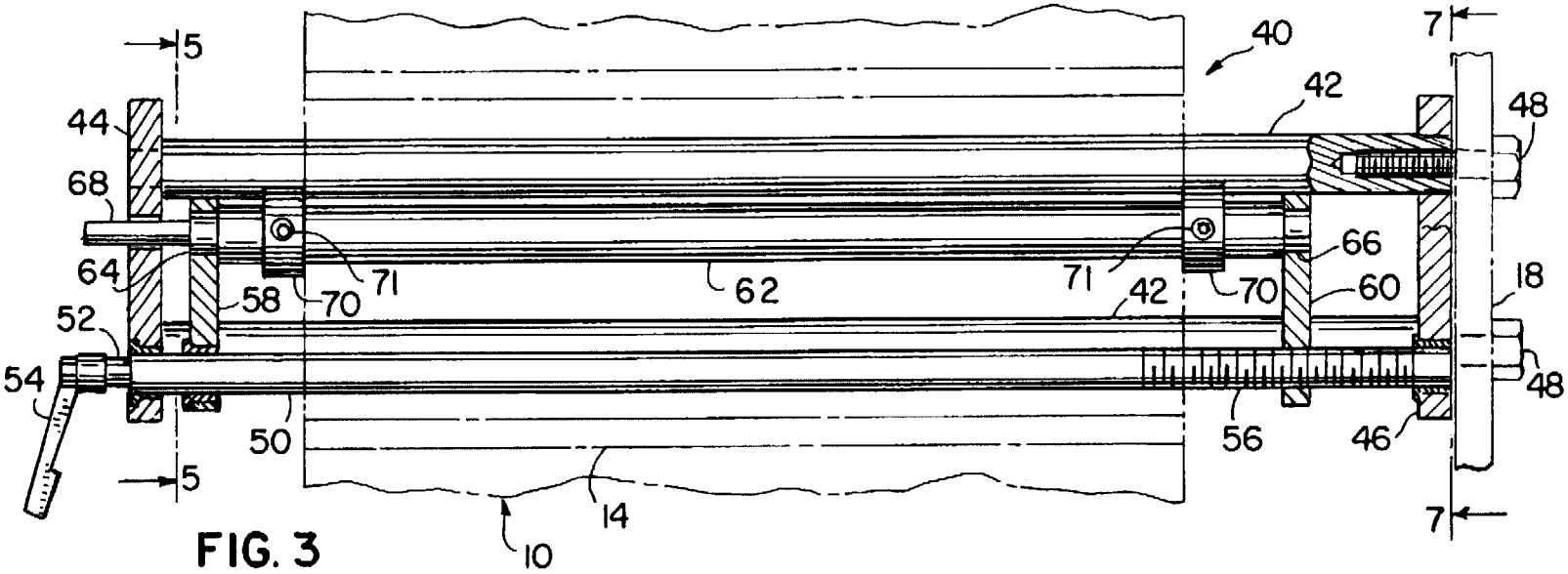
FIG. 3 is a partial section view taken along line 3—3 of FIG. 2.
Figure 7:
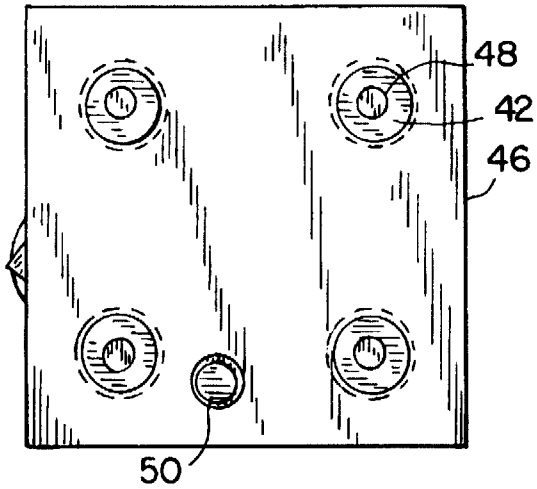
FIG. 7 is a section view taken along line 7—7 of FIG. 3.

FIG. 1 illustrates a prior art system for unwinding a roll 10 of web material 12. Web material 12 is wound about a paperboard core 14, in a manner as is known. A metal tube or mandrel 16 extends between a pair of mounting brackets 18 secured to the framework of a packaging machine 20, for rotatably mounting roll 10 adjacent machine 20. Machine 20 includes a series of rollers about which web 12 is trained, for supply to a packaging station at which the material of web 20 is packaged about a food product. Machine 20 may unwind web 12 in either a continuous or indexing manner. Mandrel 16 is longer than the width of roll 10, such that the lateral position of roll 10 on mandrel 16 can be changed as desired to provide proper tracking for web 12 as it is drawn through machine 20. To accomplish this, an arm, such as 22, is mounted to each bracket 18. A threaded rod 24 extends between brackets 18, and arms 22 are threadedly engaged with rod 24. At their outer end, each arm 22 includes a guide plate 26 and a roller 28. The lateral position of roll 10 on mandrel 16 is controlled by turning threaded rod 24, which results in lateral movement of arms 22 which functions to push one of guide plates 26 against the outer edge of roll 10 to move roll 10 along mandrel 16. As noted above, however, this can result in buckling or wrinkling of the edges of roll 10 which are engaged by guide plates 26, or "telescoping" of the convolutions of roll 10.

A roll support, guide and braking mechanism 40 constructed according to the invention is shown in FIGS. 2–7, for use in place of the mechanism of FIG. 1 to rotatably support a roll 10 of web material wound about core 14. Mechanism 40 may be used in combination with any type of machine which unwinds a web of material from a wound roll, and is not limited to use with packaging machine 20.

As shown in FIGS. 2 and 3, mechanism 40 includes a series of roll support rods 42 which extend between a pair of end plates 44, 46. End plate 46 is rectangular, and is bolted to a support bracket, such as 18, associated with a machine such as packaging machine 20 for mounting mechanism 40 adjacent thereto. As shown in FIG. 3, each support rod 42 has a shoulder which engages the inner surface of end plate 46, and a series of bolts 48 extend through bracket 18 and into threaded passages formed in support rods 42 for securing mechanism 40 to bracket 18.

Support rods 42 are stationary and non-rotatable, and are arranged so as to provide a pair of upper rods 42 and a pair of lower rods 42. Rods 42 are equally radially spaced, so as to engage the internal wall of core 14 at a 900 radial spacing. The upper and lower support rods 42 are spaced equidistant from a horizontal plane passing through the longitudinal axis of core 14, which is coincident with the longitudinal axis defined by support rods 42. Similarly, the right and left pairs of support rods 42 are spaced equidistant from a vertical axis extending through the longitudinal axes of core 14 and support rods 42.

End plate 44 is circular, and defines a diameter slightly less than the inside diameter of core 14. With this construction, roll 10 can be slid longitudinally onto support rods 42 by passage of end plate 44 and support rods 42 into and through the internal passage defined by core 14.

Figure 4:
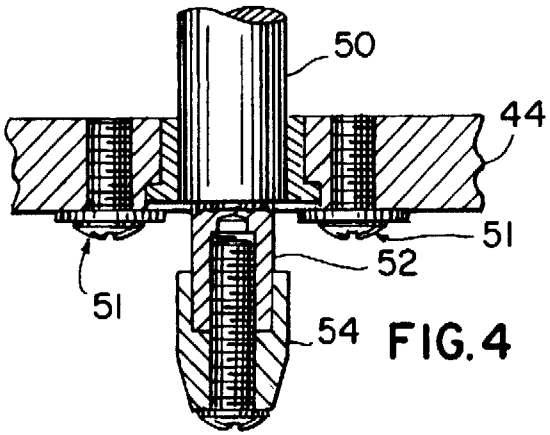
FIG. 4 is a partial section view taken along line 4—4 of FIG. 2.

As shown in FIG. 3, a shaft 50 is rotatably mounted at its ends to end plates 44, 46 via conventional bushings or the like. Shaft 50 includes an extension 52 which extends past the outwardly facing surface of end plate 44, and a handle 54 is secured to extension 52 for enabling manual rotation of shaft 50. As shown in FIG. 4, a pair of screw and washer assemblies 51 are engaged with end plate 44 one on either side of shaft 50, such that each washer overlaps an edge of a bushing which receives the end of shaft 50. This functions to prevent longitudinal pull-out of shaft 50 from end plates 44, 46.

Shaft 50 includes a threaded portion 56 at its end opposite handle 54, and extends through a pair of arms 58, 60. Arm 58 includes a bushing through which shaft 50 extends, and arm 60 includes internal threads which engage external threads 56 formed on shaft 50. With this arrangement, arms 58, 60 are pivotably mounted to shaft 50.

A brake roller shaft 62 is mounted to the outer ends of arms 58, 60 opposite shaft 50. Roller shaft 62 is an elongated cylindrical member, through which a mounting shaft extends. The ends of the mounting shaft are shown at 64, 66, which are received within openings formed in the outer ends of arms 58, 60, respectively. An extension or handle 68 extends from shaft end 64.

A pair of collars 70 are mounted to roller shaft 62. Collars 70 include set screws 71, which enable collars 70 to be slid to any desired position on roller shaft 62 and fixed in position by tightening set screws 71 onto roller shaft 62.

Figure 5:
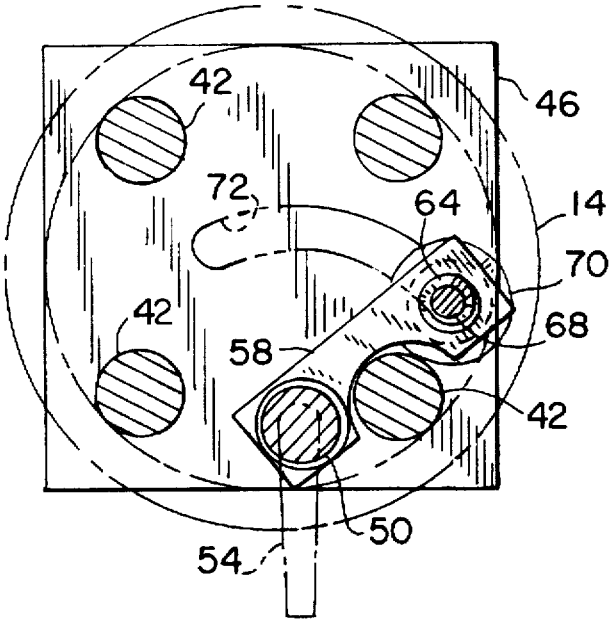
FIG. 5 is a partial section view taken along line 5—5 of FIG. 3, showing the roll brake mechanism in an engaged position.
Figure 6:
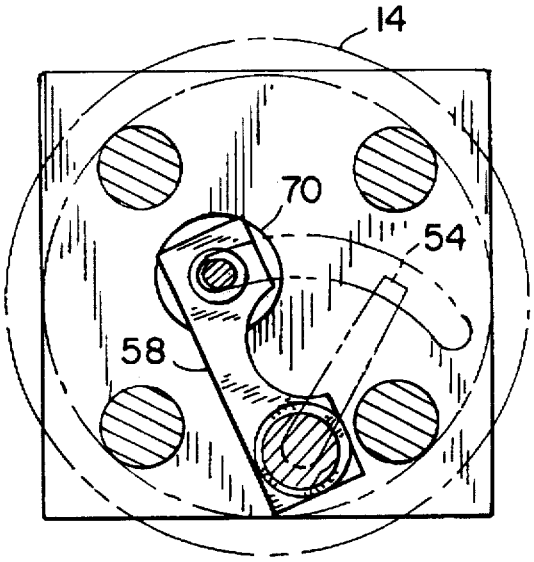
FIG. 6 is a view similar to FIG. 5, showing the roll brake mechanism in its disengaged position.

As shown in FIG. 2, an arcuate slot 72 is formed in end plate 44. Extension handle 68 extends through slot 72, and engagement of handle 68 with the ends of slot 72 controls the range of pivoting movement of roller shaft 62 relative to shaft 50. In turn, this provides movement of roller shaft 62 along an arcuate path. FIG. 5 illustrates movement of roller shaft 62 to an operative, engaged position in which roller shaft 62 engages the internal wall of core 14. In this position, handle 68 is maintained away from the end of slot 72, such that roller shaft 62 engages the internal wall of core 14 in line contact. As shown in FIG. 6, roller shaft 62 can be moved by manual operation of handle 68 to a disengaged position, in which handle 68 engages the opposite end of slot 72. The arcuate configuration of slot 72 , such that its ends are below its uppermost point, provides a gravity bias for maintaining the roller shaft in either its engaged or disengaged positions.

In operation, mechanism 40 functions as follows. To load roll 10 onto mechanism 42, roller shaft 62 is placed in its inoperative position as shown in FIG. 6 and shaft handle 54 is turned such that it does not extend past the edge of end plate 44, such as is shown in FIG. 6. Roll 10 can then be slid onto support rods 42 over end plate 44, as described previously. Support rods 42 each provide substantially line contact at one location with the internal wall of core 14, thus substantially reducing the amount of friction experienced during rotation of roll 10 over the arrangement as shown at FIG. 1. After roll 10 is initially placed onto support rods 42, the operator moves handle 68 within slot 72 so as to engage roller shaft 62 with the internal wall of core 14. The operator then places collars 70 such that each collar 70 is located immediately adjacent an end of core 14, and tightens set screws 72 so as to fix collars 70 in position. The operator can then adjust the lateral position of roll 10 on support rods 42 by turning handle 54, which rotates shaft 50 and causes lateral movement of arm 60, which is threadedly engaged with threaded portion 56 of rod 50. This movement of arm 60 results in lateral movement of brake roller shaft 62, to move roll 10 along support rods 52 via engagement of collars 70 with the ends of core 14. The pitch of threaded portion 56 of rod 50 can be made relatively fine, so as to enable an operator to provide accurate positioning of roll 10. As can be appreciated, arm 58 slides along rod 50 during such adjustment in the position of roll 10. Handle 68 has a length sufficient to extend through slots 72 throughout the full range of longitudinal movement of roller shaft 62 resulting from rotation of shaft 50.

As roll 10 is unwound, the weight of roller shaft 62 and its associated components bears against the internal wall of core 14 to apply resistance to unwinding of roll 10. As noted previously, gravity functions to apply the weight of roller shaft 62 against core 14, and the counter-rotation of roller shaft 62 about its mounting shaft provides increased resistance over that provided by a shaft which rotates in its entirety. Similarly, the line contact engagement of support members 42 provides an equally distributed amount of resistance to core 14 as compared to the prior art design of FIG. 1.

It is understood that other internal brake mechanisms analogous to roller shaft 62 may be employed, e.g. a stationary member or shaft, or a shaft which rotates in its entirety.

Various alternatives and embodiments are contemplated as being within the scope of the following claims particularly pointing out and distinctly claiming the subject matter regarded as the invention.

I claim:

1. A support for a roll having a core defining an internal passage, comprising:

a plurality of fixed position spaced, elongated support rods adapted to extend through the internal passage of the core and to engage the core at spaced locations, wherein the roll is rotatable relative to the support rods;

a brake member movable between an engaged position in which the brake member engages the core and a disengaged position in which the brake member is moved out of engagement with the core; and a roll position adjustment mechanism for adjusting the longitudinal position of the core on the support rods, including a pair of collars mounted to the brake member such that one collar is located on each side of the core and each collar engages an end of the core; a rotatable shaft extending through the core, the shaft having a threaded portion; and a pair of pivotable arms to which the brake member is mounted for providing movement of the brake member between its engaged and disengaged positions; wherein at least a first one of the arms is threadedly engaged with the threaded portion of the shaft, whereby rotation of the shaft results in longitudinal movement of the first arm, and thereby the brake member, causing longitudinal movement of the core through engagement of the collars with the core ends.

2. The roll support of claim 1, wherein the support rods each define first and second ends, wherein each support rod is interconnected at its first end with a first end plate and is interconnected at its second end with a second end plate.

3. The roll support of claim 2, wherein one of the end plates includes an arcuate slot, and wherein the brake member is interconnected with a handle member which extends through the arcuate slot, wherein the slot functions to control the range of movement of the brake member between its engaged and disengaged positions.

4. The roll support of claim 2, wherein the rotatable shaft of the roll position adjustment mechanism is rotatably mounted to the first and second end plates.

5. The roll support of claim 1, wherein both arms of the pair of arms are pivotably mounted to the rotatable shaft of the roll position adjustment mechanism.

6. A support for a roll having a core defining an internal passage for use in mounting the roll adjacent a roll unwinding device, comprising:

a plurality of spaced elongated stationary support members adapted to extend through the internal passage of the core and to engage the core at spaced locations to rotatably support the roll, wherein the plurality of spaced elongated support members comprises a plurality of elongated support rods, each of which defines first and second ends, wherein each rod is mounted at its first end to a first stationary end plate and is mounted at its second end to a second stationary end plate, and wherein one of the end plates is constructed and dimensioned so as to fit within the core passage to enable the roll to slide longitudinally onto the support rods; and a mounting arrangement interconnected with the support members for mounting the support members at a location adjacent the roll unwinding device.

7. The roll support of claim 6, wherein the plurality of support rods include at least a pair of laterally spaced upper support rods which engage the core at locations equidistant from a vertical plane passing through the longitudinal axis of the core.

8. A support for a roll having a core defining a pair of ends and an internal wall defining an axially extending internal passage, for use in mounting the roll adjacent a roll unwinding device, comprising:

a plurality of stationary spaced elongated support members adapted to extend through the internal passage of the core and to engage the core at spaced locations to rotatably support the roll, wherein the roll is longitudinally movable on and relative to the support members;

a mounting arrangement interconnected with the support members for mounting the support members at a location adjacent the roll unwinding device; and a combination roll position adjustment and roll braking mechanism interconnected with the mounting arrangement, wherein the roll position adjustment and roll braking mechanism is engageable with the core ends to move the roll on and relative to the support members along the longitudinal axis of the core internal passage to adjust the longitudinal position of the roll, and is engageable with the core internal wall to apply resistance to the core during unwinding of the roll.

9. A support for a roll having a core defining an axially extending internal passage, wherein the core defines first and second ends and includes an internal wall, comprising:

an elongated support extending through the core for rotatably supporting the roll; and a roll brake assembly comprising: a brake shaft extending through the core internal passage, wherein the brake shaft is selectively movable between an engaged position in which the brake shaft engages the internal wall of the core and a disengaged position in which the brake shaft is moved out of engagement with the core, wherein the brake shaft includes first and second end portions located exteriorly of the first and second ends of the core, respectively; and an actuator mechanism interconnected with the first and second end portions of the brake shaft for moving the brake shaft between its engaged and disengaged positions, and wherein the brake member in its engaged position functions to resist rotation of the core as the roll is unwound.

10. The roll support of claim 9, wherein the actuator mechanism comprises a pair of pivotable arms mounted to the brake shaft and wherein the arms are pivotable about a pivot axis substantially parallel to the longitudinal axis of the core internal passage, wherein pivoting movement of the arms provides movement of the brake member between its engaged and disengaged positions.

11. A support for a roll having a core defining an axially extending internal passage, wherein the core includes an internal wall, comprising:

an elongated support extending through the core for rotatably supporting the roll;

a roll brake member having a length and extending through the core internal passage, wherein the brake member is selectively movable between an engaged position in which the brake member engages the core and a disengaged position in which the brake member is moved out of engagement with the core, wherein the brake member is constructed and movably mounted relative to the core such that the brake member is spaced an equal distance throughout its length relative to the core internal wall as the brake member is moved between its engaged position and its disengaged position, and wherein the brake member in its engaged position functions to resist rotation of the core as the roll is unwound;

wherein the roll brake member is mounted to a pair of pivotable arms and wherein the arms are pivotable about a pivot axis substantially parallel to the longitudinal axis of the core internal passage, wherein pivoting movement of the arms provides movement of the brake member between its engaged and disengaged positions;

wherein the arms are pivotably mounted to a rotatable shaft, wherein a portion of the shaft is threaded, and wherein a first one of the arms is threadedly engaged with the shaft threads; and a collar mounted to the roll brake member adjacent each end of the core, wherein rotation of the rotatable shaft results in movement of the first arm and engagement of one of the collars with an end of the core to thereby move the roll longitudinally on the elongated support.

12. The roll support of claim 11, wherein the elongated support comprises a plurality of spaced roll support rods extending between and interconnected with a pair of end plates, and wherein the rotatable shaft is rotatably engaged with the end plates.

13. The roll support of claim 12, wherein one of the end plates includes an arcuate slot, and further comprising a handle interconnected with the brake member and extending through the arcuate slot, w rein engagement of the handle with the slot ends controls the range of movement of the brake member.

14. A support for a roll having a core having a pair of ends and defining an axially extending internal passage, comprising:

an elongated support extending through the core for rotatably supporting the roll, wherein the support is configured so as to enable the roll to be moved longitudinally thereon along the longitudinal axis of the internal passage; and a roll position adjustment mechanism for moving the roll longitudinally on the support, comprising a pair of collar members, each of which is selectively engageable with an end of the core, and an adjustment mechanism interconnected with the collar members for selectively and simultaneously moving the collar members in a direction substantially parallel to the longitudinal axis of the core, wherein engagement of one of the collar members with an end of the core functions to cause sliding longitudinal movement of the core, and thereby the roll, on the support.

15. The roll support of claim 14, wherein the collar members are slidably mounted to an elongated member which extends through the core passage and-are selectively engageable with the elongated member to fix their longitudinal position relative to the elongated member for positioning the collars adjacent the core ends.

16. A support for a roll having a core having a pair of ends and defining an axially extending internal passage, comprising:

an elongated support extending through the core for rotatably supporting the roll, wherein the support is configured so as to enable the roll to be moved longitudinally thereon along the longitudinal axis of the internal passage;

a roll position adjustment mechanism for moving the roll longitudinally on the support, comprising a pair of collar members, each of which is selectively engageable with an end of the core, and an adjustment mechanism interconnected with the collar members for selectively moving the collar members in a direction substantially parallel to the longitudinal axis of the core, wherein engagement of one of the collar members with an end of the core functions to cause sliding longitudinal movement of the core, and thereby the roll, on the support, wherein the collar members are slidably mounted to an elongated member which extends through the core passage and are selectively engageable with the elongated member to fix their longitudinal position relative to the elongated member for positioning the collars adjacent the core ends, and wherein the adjustment mechanism comprises an elongated rotatable shaft, a portion of which is threaded, extending through the core passage, and a pair of arms extending between the elongated member and the rotatable shaft, wherein each arm is mounted to the rotatable shaft and a first one of the arms is threadedly engaged with the threaded portion of the shaft, wherein rotation of the shaft causes longitudinal movement of the first arm in a direction parallel to the longitudinal axis of the core passage, resulting in axial sliding movement of the core along the elongated support through engagement of the collars with the core ends.

17. The roll support of claim 16, wherein the core includes a core internal wall defining the internal passage, and wherein the elongated member comprises a brake member movable between an engaged position in which the brake member engages the core internal wall and a disengaged position in which the brake member is moved out of engagement with the core internal wall, wherein the arms are pivotably mounted to the rotatable shaft.

18. The roll support of claim 17, wherein the elongated support comprises a plurality of support rods, each of which defines a first end and a second end, wherein each rod is mounted at its first end to a first end plate and is mounted at its second end to a second end plate, and wherein the rotatable shaft is rotatably mounted to the first and second end plates.

* * * * *

UNITED STATES PATENT AND TRADEMARK OFFICE

CERTIFICATE OF CORRECTION

PATENT NO. : 5,785,270

DATED : July 28, 1998

INVENTOR(S) : RAYMOND G. BUCHKO

It is certified that error appears in the above-identified patent and that said Letters Patent is hereby corrected as shown below:

Claim 6, column 6, line 61, after "passage" insert -- , --; Claim 13, column 8, line 40, delete "w rein" and substitute therefor -- wherein --; Claim 15, column 8, line 64, delete "and-are" and substitute therefor -- and are --.

Signed and Sealed this

Fourteenth Day of September, 1999

*Attest:*

Q. TODD DICKINSON

*Attesting Officer*

*Acting Commissioner of Patents and Trademarks*